US005166574A

United States Patent [19]

Yagi et al.

[11] Patent Number: 5,166,574

[45] Date of Patent: Nov. 24, 1992

[54] HIGH-TENSION CABLE DEVICE

[75] Inventors: Kiyoshi Yagi; Seiichi Wakabayashi, both of Gotenba, Japan

[73] Assignee: Yazaki Corporation, Tokyo, Japan

[21] Appl. No.: 548,521

[22] Filed: Jul. 5, 1990

[30] Foreign Application Priority Data

Jul. 14, 1989 [JP] Japan ..... 1-82245[U]
Jul. 25, 1989 [JP] Japan ..... 1-86512[U]
Jul. 25, 1989 [JP] Japan ..... 1-86513[U]

[51] Int. Cl.[5] ..... H01T 1/18; H01T 13/02

[52] U.S. Cl. ..... 313/124; 313/51; 313/135; 313/631; 123/627; 174/77 S; 439/127

[58] Field of Search ..... 313/231.01, 135, 51, 313/124, 623, 624, 625, 634, 631; 123/169 PA, 627; 439/125, 126, 127, 128; 174/77 S

[56] References Cited

U.S. PATENT DOCUMENTS 3,219,864 11/1965 Allman ..... 439/125 X
3,359,526 12/1967 Bakker ..... 313/135 X
3,605,074 9/1974 Freggens ..... 313/12 X
3,883,762 5/1975 Harris et al. ..... 313/130
3,995,183 11/1976 Lechner et al. ..... 313/124
4,475,055 10/1984 Boettcher ..... 313/633 X
4,978,309 12/1990 Straub ..... 313/51 X

FOREIGN PATENT DOCUMENTS 0048407 3/1982 European Pat. Off. .
0099522 2/1984 European Pat. Off. .
2204988 8/1973 Fed. Rep. of Germany .
1366529 9/1974 Fed. Rep. of Germany .
0150275 8/1981 Fed. Rep. of Germany .
3023288 1/1982 Fed. Rep. of Germany .
3302878 8/1984 Fed. Rep. of Germany .
51-32180 9/1976 Japan .
1358670 7/1974 United Kingdom .

*Primary Examiner*—Donald J. Yusko
*Assistant Examiner*—Ashok Patel
*Attorney, Agent, or Firm*—Nikaido, Marmelstein, Murray & Oram

[57] ABSTRACT

A gas-filled discharge tube in which a cylindrical protection terminal is fitted to a gas-charging pipe passed through an electrode, and the electrode, the gas-charging pipe and the protection terminal are connected by electrical conductive binder filled in a clearance of these elements. A high-tension cable device in which at least one of a connector terminal or a power supplying terminal is formed with a concave part fitted, contacted with a connection part of an additional function parts such as a series-gap forming discharge tube. A high-tension cable device has a concave part covering an entire connection part of the additional function part and has a threaded part at an inner surface. An outer surface of the connection part of the function part corresponding to the concave part is formed with a threaded part.

5 Claims, 5 Drawing Sheets

HIGH-TENSION CABLE DEVICE

BACKGROUND OF THE INVENTION

Field of the Invention

This invention relates to a voltage controlling discharge tube, and more particularly to a gas-filled discharge tube to be used as a series-gap in an ignition device of an automobile engine and the like.

This invention relates to a high-tension cable device, and more particularly, to a high-tension cable device which is preferable for an ignition device having a series-gap for an automobile engine and the like.

Although the ignition device in an automobile engine and the like is constructed such that a high voltage is applied to an ignition plug to generate a spark, there is proposed a so-called ignition device having a series-gap having a discharge clearance in series with an ignition plug in order to make an accurate control of an ignition time as well as to prevent occurrence of smoking at the ignition. As such a series-gap forming device, it is already known to provide a discharge tube having discharge electrodes at both ends of the cylinder and having inert gas filled therein.

As the correct controlling of the ignition time of the ignition plug by using the series-gap discharge tube, it is necessary to have a certain higher degree of a discharge starting voltage of the discharge tube as compared with that of the ignition plug. Then, in order to increase the discharge starting voltage while keeping a small-sized shape of the discharge tube, it is already known to provide a method for increasing a pressure of the filled inert gas.

In the prior art, in case of assembling the discharge tube, it has been employed to airtightly connect the cylinder made of electrical insulating material enduring against a high voltage, for example, glass or ceramics and the like with some metallic electrode terminals by using glass frit or metallic solder and the like. In such a process, it has been suggested that the process is carried out in a vacuum electric furnace in order to keep quality of the discharge tube. To the contrary, the assembling the gas-filled discharge tube requires to change-over atmosphere within the electric furnace from its vacuum state to gas atmosphere. Filling high pressure gas requires an anti-voltage characteristic of the electric furnace, resulting in that the assembling device is not only large in size and complex but also its number of steps is increased and is not economical.

In turn, since a high vibration is always applied to the ignition device in the automobile engine and the like, it is necessary for the high voltage cable device supplying a high voltage to the ignition plug to endure against vibration and further the series-gap discharge tube to be assembled in the high voltage cable device and its connecting device are required to endure against vibration.

It is already known to provide an ignition device in which a so-called series-gap is arranged in series with an ignition plug so as to prevent sooting at the ignition plug caused by adhesion of carbon and the like (refer to Jap. U. M. Laid-Open No. Sho 63-101486).

FIG. 4 illustrates a high-tension cable device C to be used in this type of prior art ignition device, in which a plug cap 25 fixed to an extreme end of a high-tension cable 24 in communication with the power supplying side is removably attached to a terminal 23 of the ignition plug 22 threadably fitted to the cylinder head 21 of the engine. The plug cap 25 is composed of a substantial cylindrical casing 26 and then a connector terminal 27 capable of being engaged with the terminal 23 of the ignition plug 22 and a power supplying terminal 28 connected to an end part of the high-tension cable 24 are spaced apart longitudinally within the casing 26 in opposition to each other.

A discharge tube 29 forming a so-called series gap S is assembled within the casing 26 as an additional function part. The electrode terminals 30 and 31 of the discharge tube 29 are fitted and contacted with the connector terminal 27 and the power supplying terminal 28 of the casing 26.

Since the aforesaid high-tension cable device C is directly fixed to the engine, there is a possibility that the discharge tube 29 assembled in the aforesaid casing 26 is damaged by a certain vibration of the engine and the like. Due to this fact, it is already proposed that a clearance 32 formed between the aforesaid discharge tube 29 and the casing 26 is filled with filler material 33 such as thermosetting resin and the like so as to protect the discharge tube 29 against vibration.

Under a circumstance described above, the present invention may provide a gas-filled discharge tube which is endurable against vibration and applied to a series-gap unit.

An object of the present invention is accomplished by a gas-filled discharge tube having a pair of electrodes at both ends of an electrical insulating cylinder and having gas filled therein characterized in that a cylindrical protection terminal is fitted to the gas-charging pipe passed through the electrode, said electrode, said gas-charging pipe and said protection terminal are connected by electrical conductive binder filled in a clearance of these elements.

Since the gas-filled discharge tube of the present invention is made in such a way as, for example, it is assembled in vacuum, gas having desired composition is fed into the gas-charging pipe passed through the electrode to become a desired pressure and then the gas-charging pipe is sealed, its sealed end is projected out of an external end surface of the electrode. At the sealed end is fitted a cylindrical protective terminal and also connected the electrode, so that when it is assembled as a series-gap unit to a high voltage cable to be fitted to an ignition plug, for example, a positive assembling operation which is highly durable against vibration can be attained.

However, since the aforesaid filler material 33 is in liquid form in case of filling operation, flowed into fine clearances and then is hardened afterwards, the filler material 33 may enter the fitted contacted part between the terminals 30, 31 of the discharge tube 29 and the terminals 27 and 28 of the casing 26 and it shows a problem that a poor electrical contact is produced.

In view of the foregoing, the present invention is completed, and it is an object of the present invention to provide a high-tension cable device capable of preventing a poor electrical contact between the additional function part such as a discharge tube assembled within the casing and the terminal of the casing.

The high-tension cable device of the present invention in order to accomplish the aforesaid object has an additional function part such as a series-gap forming discharge tube in the casing having at its one end a connector terminal capable of being engaged with a terminal of the ignition plug and having at its other end a power supplying terminal connected to a high-tension cable communicating with the power supplying side characterized in that at least one of the aforesaid connector terminal or the power supplying terminal is formed with a concave part fitted to and contacted with the connection part with the aforesaid additional function part and covering an entire connection part.

According to the present invention, at least one of the connector terminal at the casing to which the additional function part is assembled or the power supplying terminal is formed with a concave part fitted to and connected with a connection part of the additional function part and covering an entire connection part, so that even if filler material which is in a liquid form during filling and hardened after the filling is filled around the aforesaid functional part, the filler material may not enter the fitted and connected part between the terminal at the aforesaid casing and the connected part of the additional function part.

The present invention is characterized in that at least one of the aforesaid connector terminal or the power supplying terminal is formed with a concave part covering an entire connector part of the aforesaid additional function parts and having a threaded part in it and at the same time a threaded part is formed at an outer surface of the connecting part of the aforesaid additional function parts corresponding to the concave part.

DESCRIPTION OF THE PREFERRED EMBODIMENTS

Figure 3:
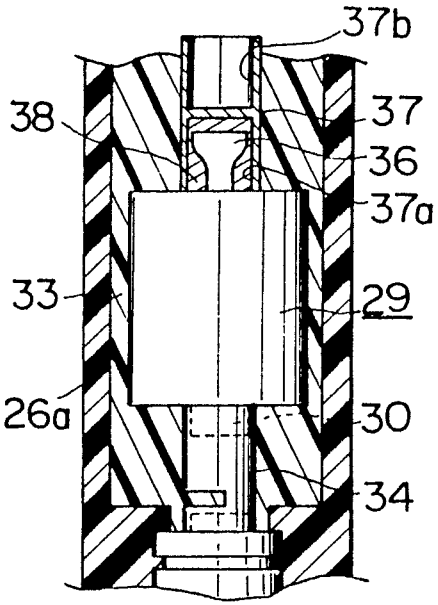
FIG. 3 is a partial enlarged sectional view showing another preferred embodiment.

Referring now to the drawings, an example of a gas-filled discharge tube of the present invention will be described.

Figure 1:
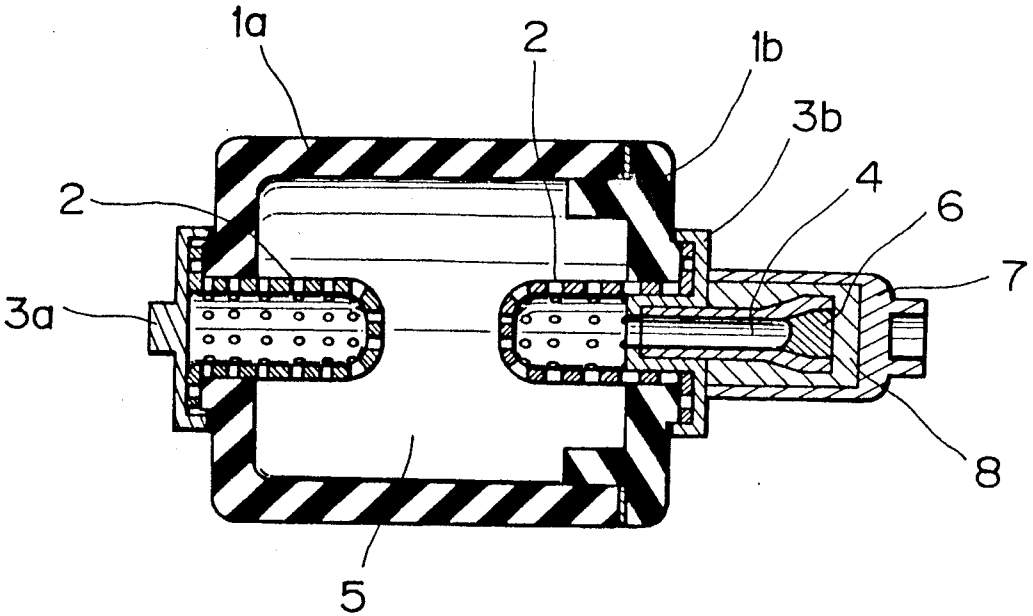
FIG. 1 is a sectional view showing a structure of a gas-filled discharge tube of the present invention.

In FIG. 1, 1*a* and 1*b* denote composing members for a ceramic insulating cylinder. 2 and 2 denote electrodes which are formed by pressing a porous metallic plate. 3*a* and 3*b* denote electrically conductive electrode blocks having electrodes 2 fixed thereto and air-tightly connected to and fixed to the composing members 1*a* and 1*b* of the insulating cylinder.

A gas-filled tube 4 is air-tightly fixed to an axial through-hole of the electrode block 3*b*. After gas of desired composition is fed into an inner space 5 to become a desired pressure, thereafter the gas-charging pipe 4 is squeezed to be sealed by using seal material 6 such as metallic solder and the like. Although the sealed part of the gas-charging tube 4 is projected out of the electrode block 3*b*, a cylindrical protection terminal 7 is fitted to it. In addition, in a space around the gas-charging pipe 4 in the protection terminal 7 is filled electrical conductive binder 8 such as silver solder, solder or other metallic solder or electrical conductive epoxy adhesive agent and the like so as to assure an electrical conduction between the electrode 2 and the protection terminal 7.

Such a protection terminal 7 may prevent an external force from being directly applied to the gas-charging pipe 4 and at the same time prohibit an occurrence of leakage of the filled gas. The protection terminal 7 is connected to the connection terminals of other component elements to support the discharge tube itself.

Figure 2:
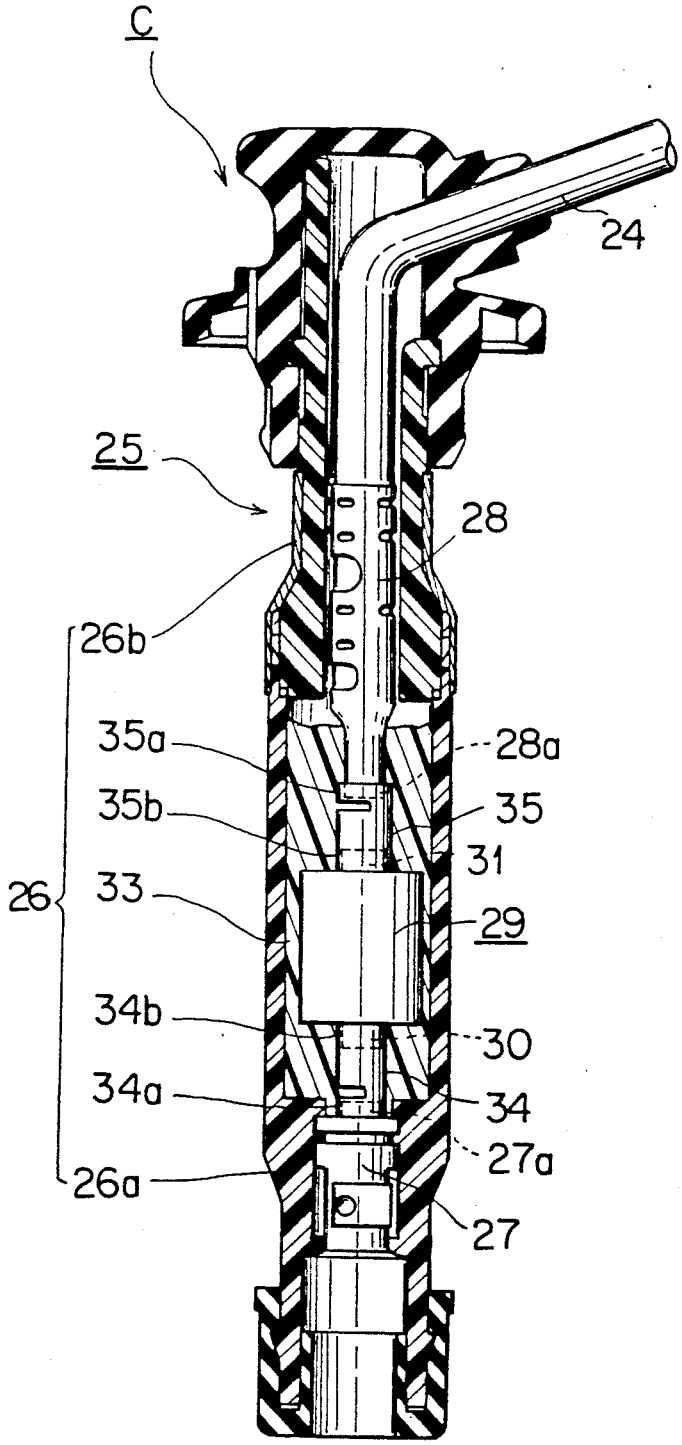
FIG. 2 is a sectional view showing one preferred embodiment of the present invention.
Figure 4:
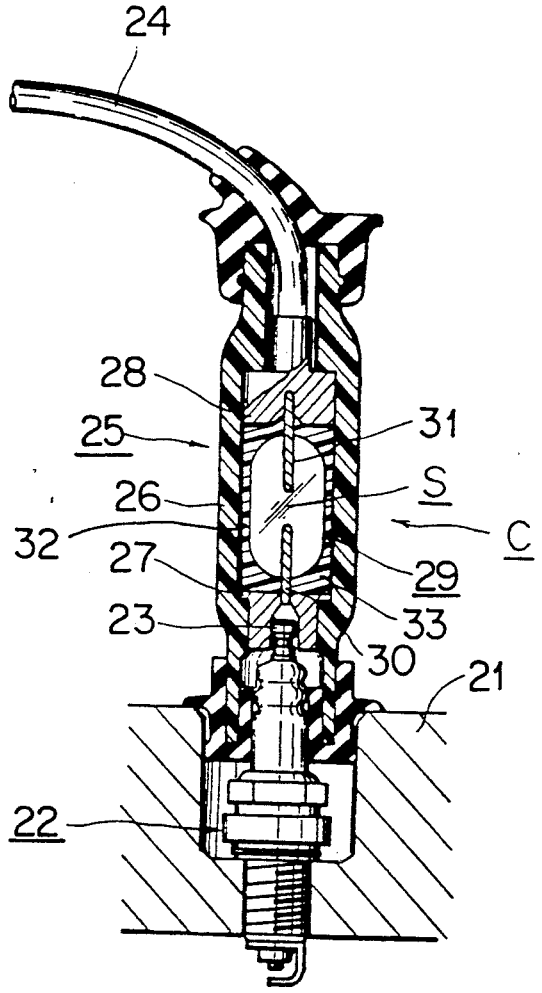
FIG. 4 PRIOR ART
FIG. 4 is a sectional view showing a prior art high-tension cable device.

Referring now to FIGS. 2 and 3, the preferred embodiment of the present invention will be described and the same portions as those of the prior art will be denoted with the same reference numerals.

FIG. 2 illustrates one preferred embodiment of the present invention, wherein a plug cap 25 fixed at an extreme end of the high-tension cable 24 and removably fitted to a terminal of the ignition plug is composed of an approximate hollow cylindrical casing 26. This casing 26 is formed by assembling a first casing 26*a* having a connection terminal 27 capable of being engaged with the terminal of the ignition plug, and a second casing 26*b* having a power supplying terminal 28 connected to the high-tension cable 24 communicating with the power supplying side. An additional function part such as a discharge tube 29 forming a so-called series gap S is assembled in the casing 26.

The aforesaid connector terminal 27 is formed with a projection 27*a* projecting in the casing 26. One end 34*a* of the joint terminal 34 having female threads at its both ends is fitted to and contacted with the projection 27*a*. One electrode terminal 30 of the aforesaid discharge tube 29 is fitted to and contacted with the aforesaid discharge tube 29. Both projections 27*a* of the aforesaid connector terminal 27 and the electrode terminal 30 of the discharge tube 29 are completely covered by the aforesaid joint terminal 34 so as to prevent their fitted and contacted portions from being exposed.

Similarly, one end 35*a* of the joint terminal 35 having both female threaded ends is fitted to and contacted with the extreme end 28*a* of the power supplying terminal 28 which projects into the aforesaid casing 26. The other end 35*b* of the joint terminal 35 is fitted to and contacted with the other electrode terminal 31 of the aforesaid discharge tube 29. The aforesaid fitted and contacted portions are completely covered by the joint terminal 35.

Thus, in the preferred embodiment, since the joint terminals 34 and 35 may cover completely the terminals 30 and 31 of the discharge tube 29 and the terminals 27 and 28 at the casing 26 side so as to perform a fitting and contact between the discharge tube 29 and the casing 26, resulting in that even if filler material 33 such as thermosetting resin kept in a liquid form during its filling operation and hardened after its use is filled in the casing 26 in order to fill the clearance 32 formed between the discharge tube 29 and the casing 26, the filler material 33 does not enter the aforesaid fitted and contacted portions. A poor electrical contact at the connection part caused by the filler material 33 may not be produced and so the discharge tube 29 can be burred and fixed by the filler material 33.

A mere fitting and contacting of the discharge tube 29 to and with the joint terminals 34 and 35 enables a positioning of the discharge tube 29 to be set within the casing 26 and then assembling characteristic and workability in performing the assembling of the aforesaid high-tension cable device C are remarkably improved.

In order to make a more positive electrical connection between the aforesaid joint terminals 34 and 35 and the discharge tube 29 and the casing 26, it is better to fill electrically conductive epoxy resin in advance within the joint terminals 34 and 35 before the fitting and contacting operation.

FIG. 3 illustrates another preferred embodiment of the present invention, wherein one electrode terminal 36 of the discharge tube 29 is formed as a pipe for enclosing inner gas within the discharge tube 29. In this case, the joint terminal 37 to be fitted and contacted with the aforesaid electrode terminal 36 is formed as an approximate tubular form of which inner part is partitioned into two segments, the aforesaid electrode terminal 36 is stored within one chamber 37*a* of this joint terminal 37 and at the same time a solder 38 is filled in it and further the terminal at the casing 26 is fitted to and contacted within the other chamber 37*b*.

With such an arrangement, it is possible to protect the pipe-like electrode terminal 36 acting as the gas filling part while keeping a better electrical contact with the discharge tube 29 and the casing 26 and further it is also possible to prevent any leakage of inert gas from the discharge tube 29 caused by damage of the aforesaid pipe-like electrode terminal 36.

In the aforesaid preferred embodiments, although the joint terminals 34, 35 (37) are arranged between the connector terminal 27 and the power supplying terminal 28 of the discharge tube 29 and the casing 26, it is not necessary to arrange the joint terminals at both aforesaid connector terminal 27 and the power supplying terminal 28, but the joint terminal is applied only at the side where the filler material 33 is used to bury it and the side not buried with the aforesaid filler material 33 may be the conventional connector means.

As described above, the joint terminals 34, 35 (37) are not formed as a single unit, but they may be made integral with the aforesaid connector terminal 27 of the power supplying terminal 28.

Even if the additional function parts to be assembled in the aforesaid casing 26 is a resistor for eliminating noise, for example, in place of the aforesaid discharge tube 29, a similar effect can be attained.

Figure 5:
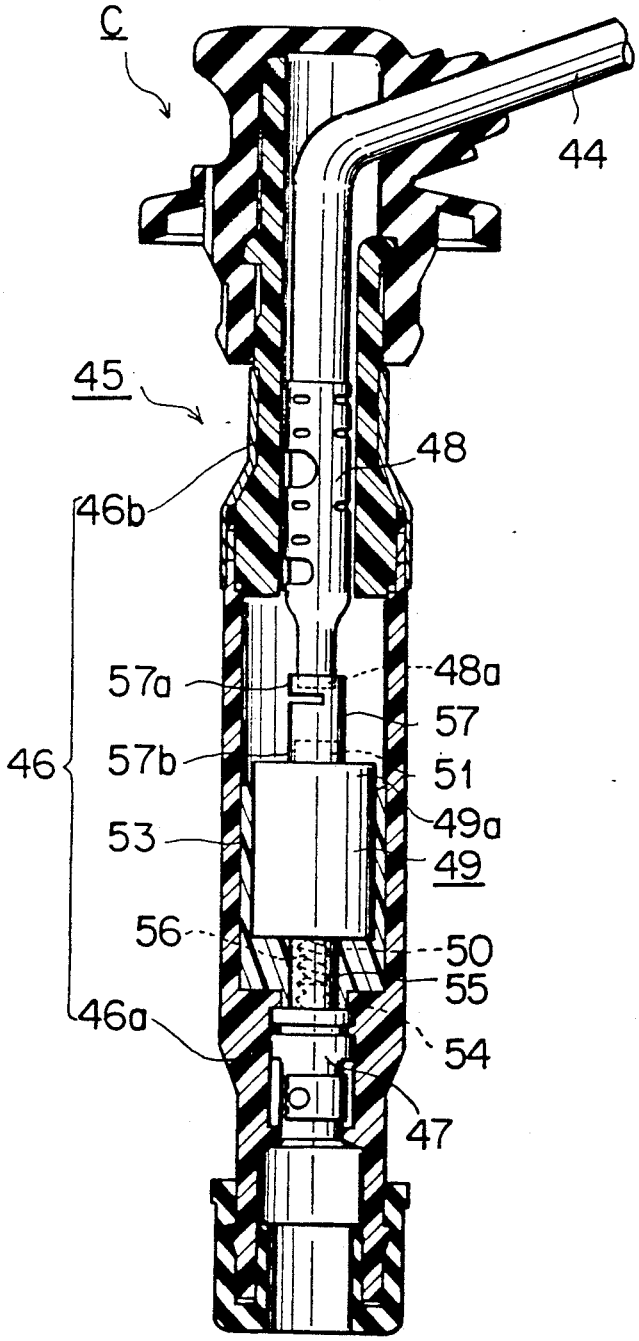
FIG. 5 is a sectional view showing one preferred embodiment of the present invention.
Figure 7:
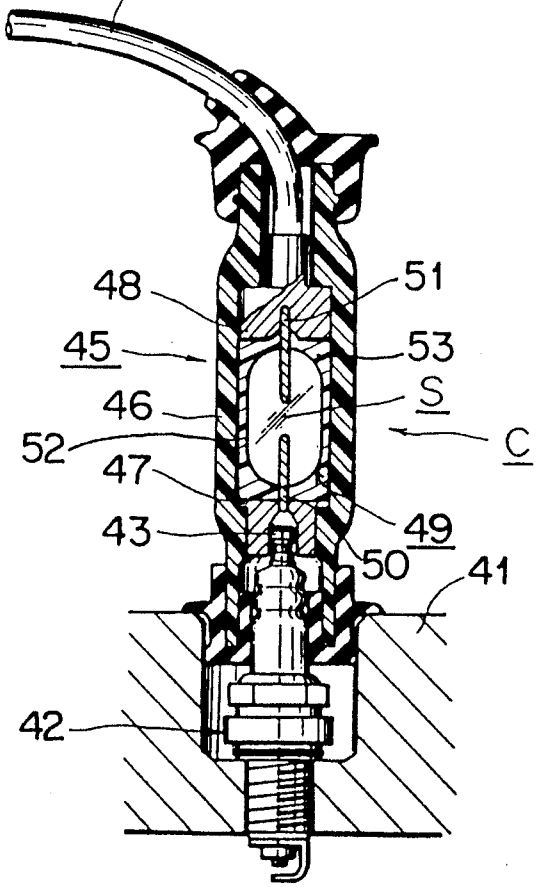
FIG. 7 PRIOR ART
Figure 6:
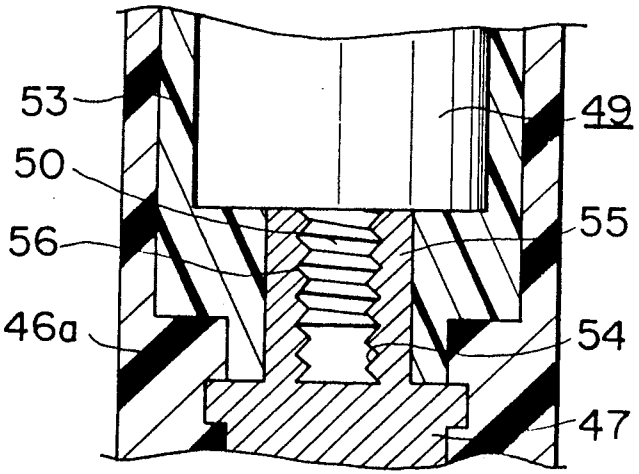
FIG. 6 is a partial enlarged sectional view of FIG. 1.

In a still further embodiment as shown in FIG. 5 and FIG. 6, a hub part 55 projected into the casing 46 and having a threaded part 54 at its inner surface is integrally formed with the aforesaid connector terminal 47, and one electrode terminal 50 of the aforesaid discharge tube 49 corresponding to the hub part 55 is formed with a threaded part 56 which is threadably engaged with the aforesaid threaded part 54 at its outer surface. An entire electrode terminal 50 of the aforesaid discharge tube 49 is threadably inserted into the aforesaid hub 55 so as to prevent its threaded part from being exposed within the casing 46.

An extreme end 48*a* of the power supplying terminal 48 which projects into the casing 46 has one end 57*a* of the joint terminal 57 having both female ends fitted and contacted thereto. The other end 57*b* of the joint terminal 57 is fitted to and contacted with the other electrode terminal 51 of the discharge tube 49. The filler material 53 is filled within the casing 46 except this power supplying terminal 48.

In order to manufacture such a high-tension cable device C, the discharge tube 49 is inserted into the first casing 46*a* having the connector terminal 47 and one electrode terminal 50 is threadably inserted into the hub 55 of the connector terminal 47 so as to make the discharge tube 49 an independent one. Filler material 53 such as liquid thermosetting resin is poured downwardly through a shoulder part 49*a* of the independent discharge tube 49 so as to bury a substantial entire circumference of the discharge tube 49 with the filler material 53. Then, one end 57*a* of the joint terminal 57 is fitted to and contacted with the other electrode terminal 51 of the discharge tube 49 not buried in the filler material 53. In addition, the second casing 46*b* having the high-tension cable 44 having the power supplying terminal 48 at its extreme end is assembled in the first casing 46*a*, and the other end 57*b* of the joint terminal 57 and the power supplying terminal 48 are fitted to and contacted with each other to complete the assembly of the high-tension cable device C.

Accordingly, in accordance with the preferred embodiment, the electrode terminal 50 of the discharge tube 49 is completely threadably fitted into the hub part 55 of the connector terminal 47, and the threadably engaged portions of the connector terminal 47 and the discharge tube 49 are not exposed within the casing 46, so that even if the filler material 53 in a liquid form during filling operation and hardened afterwards is filled in the casing 46 in order to fill the clearance 52 formed between the discharge tube 49 and the casing 46, the filler material 53 may not enter the threaded portions, and thus it is possible to bury and fix the discharge tube 49 with the filler material 53 without making any poor electrical contact at the connection portions by the filler material 53.

Since the discharge tube 49 is made independent due to a threaded engagement of the discharge tube 49 with the connector terminal 47, it is possible to facilitate a positioning of the discharge tube 49 within the casing 46 and thus an assembling characteristic and workability in case of assembling the high-tension cable device C are improved.

If an interface between the hub part 55 and the electrode terminal 50 is sealed with electric conductive epoxy resin adhesive agent and the like, a more positive electrical contact could be attained.

In the aforesaid preferred embodiment, only the connector terminal 47 is of a threadably engaged structure. However, if the power supplying terminal 48*a* is also enclosed by the filler material 53, a similar configuration of the power supplying terminal 48 enables a positive electrical connection to be attained. In addition, if the filler material 53 is fed from the connector terminal 47 in opposition to the aforesaid preferred embodiment so as to enclose only the power supplying terminal 48 with the filler material 53, it may be sufficient to provide the aforesaid threadably engaged structure for only the power supplying terminal 48.

In addition, even if the additional function parts to be assembled in the casing 46 is a noise attenuating resistor in place of the discharge tube 49, for example, a similar effect may be attained.

The gas-filled discharge tube of the present invention is constructed such that a gas-filled tube is arranged at the electrode fixed to an end part of the electrical insulating cylinder, a cylindrical protective terminal is fitted to it and connected and fixed to it with electrical conductive binder, in which either composition or pressure of the filled gas can easily be adjusted, so that products having uniform quality can be economically attained. In case of assembling into various devices, the present invention may provide not only an easy installing operation, but also no possibility of making looseness of installation or gas leakage due to its vibration.

As described above, the high-tension cable device made in accordance with the present invention is constructed such that at least one of the connector terminal at the casing side or the power supplying terminal is formed with a concave part to be fitted to and contacted with the connector part of the additional function part and to cover the entire connector, so that it may provide effects that even if the filler material kept in liquid form during filling operation and hardened after it is filled around the aforesaid additional function part, the filler material may not enter the fitted and contacted part between the terminal at the aforesaid casing side and the connector part of the additional function part and any poor electrical contact between the additional function part and the casing side through the aforesaid filler material can be prevented.

As described above, the high-tension cable device of the present invention is constructed such that at least one of the connector terminal of the casing to which the additional function parts is assembled or the power supplying terminal is formed with a concave part covering an entire connection part of the additional function parts and having a threaded part at its inner surface, and further an outer surface of the connection part of the additional function parts, so that the present invention may provide some effects that even if the filler material in a liquid form during filling operation or hardened afterwards is filled around the aforesaid additional function parts, the filler material may not enter the threadably engaged portions between the terminal at the casing and the connection part of the additional function parts and thus a poor electrical contact between the additional function part and the casing by the filler material can be prevented.

What is claimed is:

1. A high-tension cable device in which an additional function part such as a series-gap forming discharge tube is assembled in a casing having a connector terminal at its one end capable of being engaged with a terminal of an ignition plug and having an electrical power supplying terminal connected with the high-tension cable at the other end thereof communicating with the power supplying side, wherein at least one of said connector terminal and the power supplying terminal is formed with a joint terminal fitted and contacted with a connection part of said additional function part, said joint terminal having an inner surface which is formed into a first threaded part covering an entire connection part of said additional function part, and an outer surface of said connection part of said additional function part is formed into a second threaded part corresponding to said first threaded part.

2. A high-tension cable device as set forth in claim 1, wherein said additional function part has a first and second connection part at opposite ends thereof, said connector terminal forms an ignition plug side connection in cooperation with said first connection part, said power supply terminal forms a power supply side connection in cooperation with said second connection part, and said high-tension cable device further comprises means for covering at least one of said ignition plug side connection and said power supply side connection to provide electrical connection therebetween.

3. A high tension cable device according to claim 2, wherein said covering means includes a joint terminal.

4. A high tension cable device according to claim 3, wherein said second connection part of the discharge tube is formed to function as a gas charging pipe, said joint terminal covering said second connection part and being divided into a power cable side and a discharge tube side, said discharge tube side covering said second connection part of the discharge tube and filled with electrical conductive epoxy resin.

5. A high tension cable device according to claim 3, wherein said joint terminal and the mating connection part of the discharge tube being threaded with each other.

* * * * *